United States Patent [19]

Bataille

[11] 4,236,725

[45] Dec. 2, 1980

[54] DYNAMIC DEVICE FOR HOLDING THE FOOT AND THE LEG IN POSITION IN A RIGID STRUCTURE

[76] Inventor: Jean-Roger Bataille, 20, rue du Commandant Rene Mouchotte, Paris, France

[21] Appl. No.: 953,602

[22] Filed: Oct. 23, 1978

[30] Foreign Application Priority Data

Oct. 28, 1977 [FR] France ..... 77 32577

[51] Int. Cl.[3] ..... A63C 9/086

[52] U.S. Cl. ..... 280/611; 36/93; 280/618

[58] Field of Search ..... 280/611, 613, 618; 36/93, 88, 119, 118, 117, 120, 121

[56] References Cited

U.S. PATENT DOCUMENTS

| | | | |
|---|---|---|---|
| 3,947,051 | 3/1976 | Sittmann | 280/611 |
| 4,178,013 | 12/1979 | Bataille | 280/611 |

FOREIGN PATENT DOCUMENTS

| | | | |
|---|---|---|---|
| 1960126 | 6/1971 | Fed. Rep. of Germany | 280/611 |
| 2162619 | 6/1973 | Fed. Rep. of Germany | 36/93 |
| 2708358 | 9/1977 | Fed. Rep. of Germany | 280/611 |

*Primary Examiner*—David M. Mitchell

*Attorney, Agent, or Firm*—Wolf, Greenfield & Sacks

[57] ABSTRACT

A dynamic device for holding the foot and the leg in position in a rigid structure consisting of shells or fastening elements, wherein there is at least a pump operated by the motions of the leg which is associated with at least an element for adjusting the pressure, with at least a valve and an assembly of fluid-chocks, the whole participating to the immobilization of the foot and the leg in the rigid structure.

13 Claims, 1 Drawing Figure

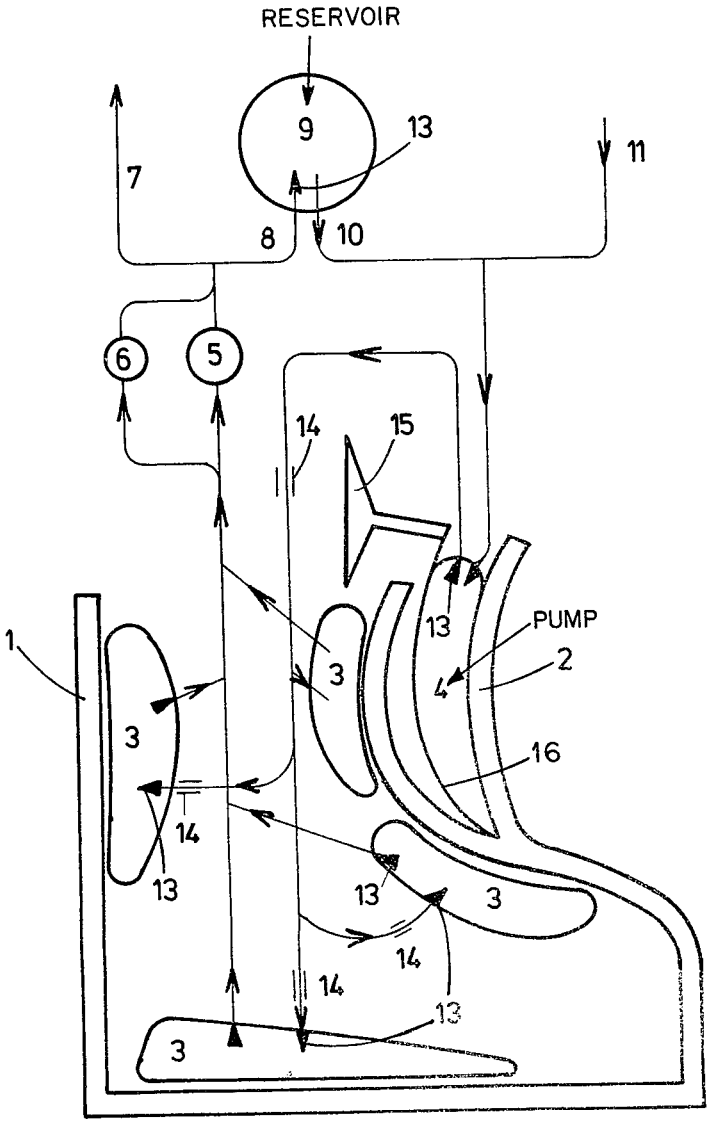
RESERVOIR
9
13
11
7
8
10
6
5
14
15
13
PUMP
2
4
1
3
3
16
14
13
13
3
14
14
13
3

DYNAMIC DEVICE FOR HOLDING THE FOOT AND THE LEG IN POSITION IN A RIGID STRUCTURE

The presente invention relates to a dynamic chocking system acting between a rigid assembly of shells or elements holding the foot and the leg in position, the latter bearing or not non-rigid shoes or slippers, the whole making it possible to improve ski performances or any other dynamic activities necessitating the immobilization of the foot and of the leg.

Numerous systems for immobilizing the foot and the leg by means of fluid-chocks are already known. See, for example the previous U.S. Pat. No. 4,178,013 to the same inventor.

The present invention is aimed at the recovering of the work of the leg in its checked or unchecked motions any time skiing is performed.

To this end, the present invention provides a dynamic assembly for chocking the foot and the leg in a rigid structure consisting of shells or fastening elements, wherein at least a pump operated by the motions of the leg is associated with at least an element for adjusting the pressure, with at least a valve and an assembly of fluid-chocks, the whole participating to the immobilization of the foot and the leg in a rigid structure.

According to a further characteristic of the invention, a set of valves, or the like, make it possible to adjust the flow and pressure of the fluid at any part of the system.

According to another characteristic of the invention, the pump consists of a follower applied either on the front or the rear of the leg by means of a large spring blade which under the effect of the thrust of the leg crushes a flexible pocket integral therewith and which constitutes the body of the pump, against a flat and rigid element fixed on the rigid assembly.

According to a further characteristic of the invention, the pump is positioned at any point of the device from which it can be operated by the motions of the leg.

According to a further characteristic of the invention, the pump operated by the leg is of a type already known.

According to another characteristic of the invention, the pump is adapted to the gas or liquid it draws from a reservoir.

According to another characteristic of the invention, the pump is adapted to the air it draws from the atmosphere.

The present invention will be better understood by means of the modes of embodiment diagrammatically shown by way of example in the attached drawing.

As shown in said drawing, the assembly shell 1 and rigid flat shaped element 2 fixed onto the shell assembly, constitute an obstacle to the expansion of the chocks 3 and of the flexible pump body 4. All the above-mentioned elements are shown in cross-section; the following ones constitute a working diagram. The element 5, a check valve, of a known type checks the pressure, the element 6, another valve, of a know type makes it possible to have the system communicate with the atmosphere: it is submitted to an external action. The channel 7 enables the system to empty into the atmosphere under the action of the element 5. According to a variant, the channel 8 enables the system to empty into the reservoir 9. According to variants, the circuits 10 and 11 feed the pump 4. The whole of the circuit is equipped with valves 13 and diaphragms 14 of different flows, the diameter of which is shown in two parallel lines not equally distant from one another located on each side of the unbroken line showing the channel. The follower 15 shown in cross-section makes it possible for the leg to act upon the spring 16 also shown in cross-section. The flexible body of the pump is integral with the spring 16 through one of its walls and with the rigid shaped element 2 through its opposite one.

WORKING OF THE DEVICE

After the introduction of the foot and the leg into the shell assembly 1, and the adjustment of the element regulating the pressure valve 5, the leg (the tibia in this example) acts upon the follower 15 which transmits the pressure to the spring 16 which crushes the body of the pump 4 and drives the fluid through the circuit along the direction of the arrows, said direction being assigned by the valves and clappers 13. The fluid reaches the respective chocks at a different speed depending on the diameter of the diaphragms 14. As soon as the leg enables it, the spring 16 pulling off the body of the pump fills up the latter. Pumping is performed till the immobilization of the leg by the chocks 3, a relative immobilization corresponding to the pressure permitted by the pre-adjusted element 5 ensuring the readjustment or pressure. Any over-pressure beyond the threshold selected when the adjustment is performed and due to an effort or an excess of pumping causes a leakage of fluid through the element 5. The fluid flowing from the circuit through the element 5 discharges according to a variant, either into the atmosphere through the circuit 7, or into the reservoir 9 through the circuit 8, from which it will be drawn out by the pump through the circuit 10 if, according to a variant, it does not run through the circuit 11 discharging into the atmosphere. When for example the element 6 is actuated by hand, it releases the fluid under pressure, through a single expansion where a gas is involved, or through a motion of the foot and the leg acting upon the chocks where a fluid is involved. According to a variant, the fluid flows either through the circuit 7 or the circuit 8. Afterwards, it only remains to simply release the foot and the leg from the device.

The number and positioning of the chocks, pumps, elements regulating the pressure, valves, diaphragms and clappers are not rigorous and are determined in view of the practical way of using or handling the device by the user thereof.

Of course, the invention is not limited to the examples of embodiment described and represented hereabove, from which further variants can be provided without thereby departing from the scope of the invention.

What I claim is:

1. A device for fixing the foot and the leg to a utilization member, comprising;

a base member detachably connected to the utilization member, framework means extending from the base member and adapted to receive the person's foot, expandable chock means mounted to the interior of the framework to engage and clamp the foot, and pump means carried by the framework and in communication with the chock means to cause expansion of the chock means, said pump means comprising a feeler member at the top of the framework adapted for engagement with the leg above the foot and supported to receive leg forces in a direction substantially parallel to the base member, the motions of the leg onto the feeler member operating the pump means to expand the chock means for fixing the foot and the leg in position within the framework.

2. A device as set forth in claim 1 wherein the feeler member comprises a spring blade defining a gap for receiving at least a portion of the pump means wherein the spring blade, through the thrust of the leg, operates the pump means.

3. A device as set forth in claim 2 wherein the pump means includes a flexible pocket member forming the body of the pump means and disposed in the gap.

4. A device as set forth in claim 3 wherein the framework includes a rigid form which defines the other side of the gap so that upon urging of the spring blade the flexible pocket member is compressed against the rigid form.

5. A device as set forth in claim 4 wherein the spring blade and rigid form are integral with the framework.

6. A device as set forth in claim 5 wherein the spring blade and rigid form define a bifurcated extension of the framework forming the gap between them.

7. A device as set forth in claim 2 wherein the blade and pump means are contiguous as to their contact surfaces.

8. A device as set forth in claim 1 wherein the pump means is exclusively actuated by the motion of the leg.

9. A device as set forth in claim 1 including a reservoir and means coupling fluid intermediate the reservoir and pump means.

10. A device as set forth in claim 1 including control means for air flow intermediate the pump means and atmosphere.

11. A device as set forth in claim 1 wherein the pump means is fluid operated.

12. A device as set forth in claim 1 wherein the pump means is supported at a front surface of the leg.

13. A device as set forth in claim 1 including valve means disposed intermediate the pump means and chock means to control pressure applied to the chock means by the pump means.

* * * * *